US005903931A

United States Patent [19]

Kolb, Sr.

[11] Patent Number: 5,903,931

[45] Date of Patent: May 18, 1999

[54] TOILET WITH DUAL VOLUME FLUSH

[76] Inventor: Robert A. Kolb, Sr., 267 Hwy. 36, Port Monmouth, N.J. 07758

[21] Appl. No.: 09/001,726

[22] Filed: Dec. 31, 1997

[51] Int. Cl.[6] ..... E03D 3/12

[52] U.S. Cl. ..... 4/326; 4/393

[58] Field of Search ..... 4/324–327, 392, 4/393, 412–414

[56] References Cited

U.S. PATENT DOCUMENTS 1,780,810 11/1930 Brown ..... 4/326
3,375,531 4/1968 Lake ..... 4/326
3,763,501 10/1973 Minardi, Jr. ..... 4/326
5,121,510 6/1992 Ricalde Medina ..... 4/326

*Primary Examiner*—Charles R. Eloshway

[57] ABSTRACT

A double flush toilet assembly is provided including a toilet water basin defining an interior space and an open top. A bottom face of the basin has an exit for communicating with a toilet bowl. A dual flush tube has a first open end at a first elevation and a second open end at a second elevation. Each open end remains in communication with the exit of the water basin. Each open end further has a lid for allowing water to enter the same upon being opened. A pair of flushing assemblies are each connected to the corresponding lid for selectively and independently opening the same.

1 Claim, 2 Drawing Sheets

TOILET WITH DUAL VOLUME FLUSH

BACKGROUND OF THE INVENTION

1. Field of the Invention

The present invention relates to low volume flush assemblies and more particularly pertains to a new toilet with dual volume flush for allowing a user to choose between two flush volumes.

2. Description of the Prior Art

The use of low volume flush assemblies is known in the prior art. More specifically, low volume flush assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art low volume flush assemblies include U.S. Pat. No. 4,748,699; U.S. Pat. No. 4,485,501; U.S. Pat. No. 5,319,809; U.S. Pat. No. 5,191,662; U.S. Pat. No. 5,243,713; and U.S. Pat. No. 4,910,812.

In these respects, the toilet with dual volume flush according to the present invention substantially departs from the conventional concepts and designs of the prior art, and in so doing provides an apparatus primarily developed for the purpose of allowing a user to choose between two flush volumes.

SUMMARY OF THE INVENTION

In view of the foregoing disadvantages inherent in the known types of low volume flush assemblies now present in the prior art, the present invention provides a new toilet with dual volume flush construction wherein the same can be utilized for allowing a user to choose between two flush volumes.

The general purpose of the present invention, which will be described subsequently in greater detail, is to provide a new toilet with dual volume flush apparatus and method which has many of the advantages of the low volume flush assemblies mentioned heretofore and many novel features that result in a new toilet with dual volume flush which is not anticipated, rendered obvious, suggested, or even implied by any of the prior art low volume flush assemblies, either alone or in any combination thereof.

To attain this, the present invention generally comprises a toilet water basin having a rectangular configuration with a rectangular bottom face and a periphery integrally coupled thereto and extending upwardly therefrom. The water basin thus defines an interior space and an open top. The bottom face has an exit tube with a threaded interior centrally formed therein and extending downwardly therefrom. The exit tube is adapted for coupling and communicating with a toilet bowl. As shown in FIG. 3, a dual flush tube is provided having a lower horizontal extent with a downwardly extending threaded adapter integrally coupled thereto and in communication therewith. The dual flush tube is adapted for coupling with the exit tube of the toilet water basin. A pair of upper vertical extents are integrally coupled to opposite ends of the lower horizontal extent and extend upwardly therefrom. Each of the upper vertical extents terminate in an open end. Each open end has a circular lid hingably coupled thereto for pivoting between an open and a closed orientation. The upper vertical extents include a first upper vertical extent with a first height and a second upper vertical extent with a second height less than the first height for reasons that will soon become apparent. Finally, a pair of flushing mechanisms each include a handle pivotally coupled to an exterior surface of the front face of the toilet water basin. Ideally, the handles remain adjacent to opposite ends of the water basin. Levers are pivotally coupled to an interior surface of the front face of the toilet water basin. Further, the levers are each adapted to rotate coincident with an associated one of the handles. A string is coupled between an outboard end of each lever and an associated one of the lids for selectively opening the same.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet with dual volume flush apparatus and method which has many of the advantages of the low volume flush assemblies mentioned heretofore and many novel features that result in a new toilet with dual volume flush which is not anticipated, rendered obvious, suggested, or even implied by any of the prior art low volume flush assemblies, either alone or in any combination thereof.

It is another object of the present invention to provide a new toilet with dual volume flush which may be easily and efficiently manufactured and marketed.

It is a further object of the present invention to provide a new toilet with dual volume flush which is of a durable and reliable construction.

An even further object of the present invention is to provide a new toilet with dual volume flush which is susceptible of a low cost of manufacture with regard to both materials and labor, and which accordingly is then susceptible of low prices of sale to the consuming public, thereby making such toilet with dual volume flush economically available to the buying public.

Still yet another object of the present invention is to provide a new toilet with dual volume flush which provides in the apparatuses and methods of the prior art some of the advantages thereof, while simultaneously overcoming some of the disadvantages normally associated therewith.

Still another object of the present invention is to provide a new toilet with dual volume flush for allowing a user to choose between two flush volumes.

Even still another object of the present invention is to provide a new toilet with dual volume flush that includes a toilet water basin defining an interior space and an open top. A bottom face of the basin has an exit for communicating with a toilet bowl. A dual flush tube has a first open end at a first elevation and a second open end at a second elevation. Each open end remains in communication with the exit of the water basin. Each open end further has a lid for allowing water to enter the same upon being opened. A pair of flushing assemblies are each connected to the corresponding lid for selectively and independently opening the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
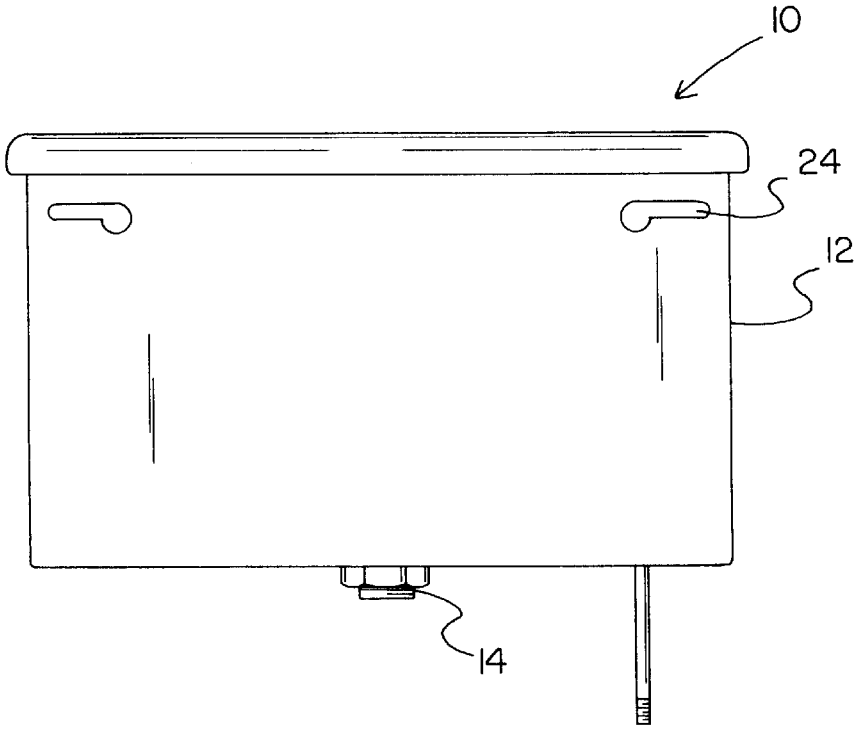
FIG. 1 is a front view of a new toilet with dual volume flush according to the present invention.

With reference now to the drawings, and in particular to FIGS. 1 through 4 thereof, a new toilet with dual volume flush embodying the principles and concepts of the present invention and generally designated by the reference numeral 10 will be described.

The present invention, designated as numeral 10, includes a toilet water basin 12 having a rectangular configuration with a rectangular bottom face and a periphery integrally coupled thereto and extending upwardly therefrom. The water basin thus defines an interior space and an open top. The bottom face has an exit tube 14 with a threaded interior centrally formed therein and extending downwardly therefrom. The exit tube is adapted for coupling and communicating with a toilet bowl.

Figure 2:
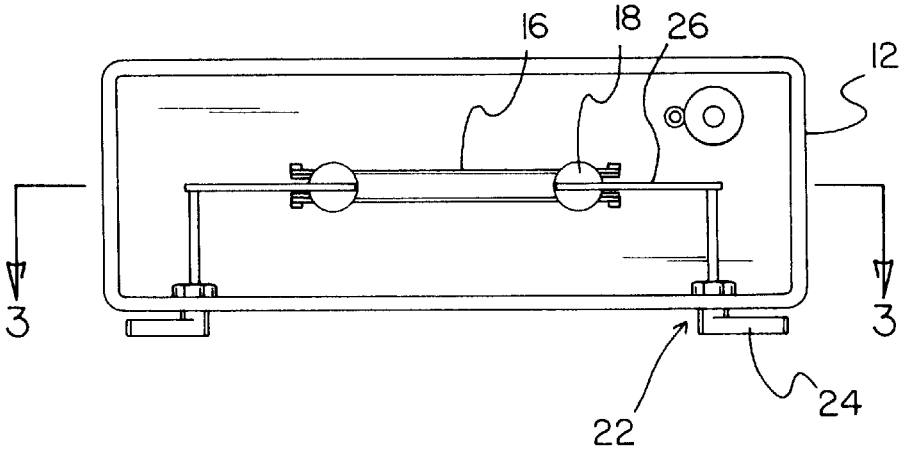
FIG. 2 is a top view of the present invention.
Figure 3:
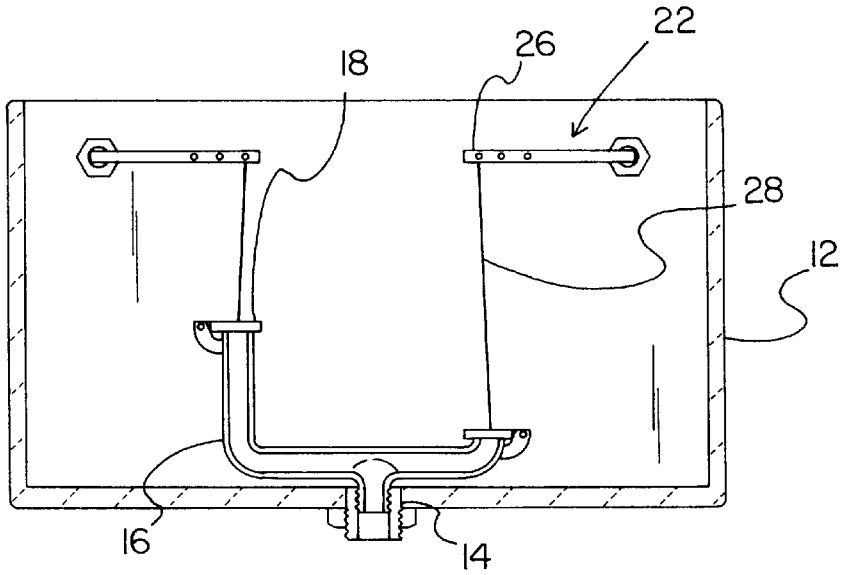
FIG. 3 is a front cross-sectional view of the present invention taken along line 3—3 shown in FIG. 2.

As shown in FIG. 3, a dual flush tube 16 is provided having a lower horizontal extent with a downwardly extending threaded adapter integrally coupled thereto and in communication therewith. The lower horizontal extent of the dual flush tube is preferably centrally situated along a lateral axis of the water basin, as shown in FIG. 2. In operation, the dual flush tube is adapted for coupling with the exit tube of the toilet water basin. A pair of upper vertical extents of the flush tube are integrally coupled to opposite ends of the lower horizontal extent and extend upwardly therefrom. Each of the upper vertical extents terminate in an open end.

Figure 4:
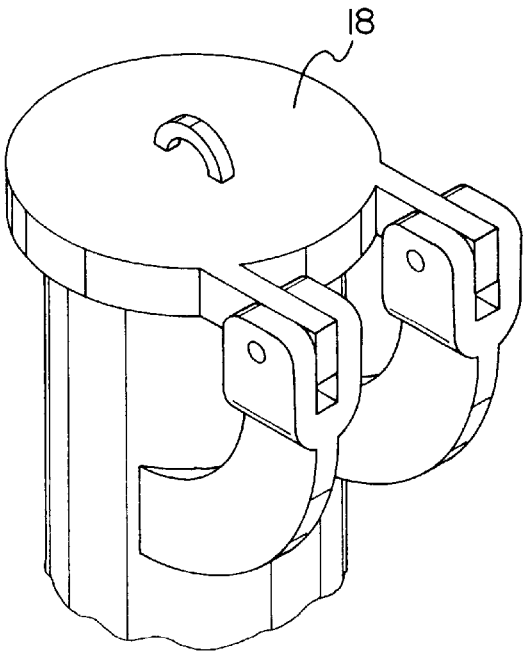
FIG. 4 is a perspective view of one of the lids of the dual flush tube of the present invention.

Each open end of the upper vertical extents has a circular lid 18 hingably coupled thereto for pivoting between an open and a closed orientation. As shown in FIG. 4, a pair of arcuate arms extend from each upper extent to define a pair of forks which are coupleable to a pair of tabs extending from the lid.

The upper vertical extents include a first upper vertical extent with a first height and a second upper vertical extent with a second height less than the first height for reasons that will soon become apparent. As shown in FIG. 3, the first height is at least twice the second height. A water supply cut off mechanism 19 is situated above the upper vertical extent of the first height a distance approximately equal the difference between the first and the second height. Such mechanisms, shown generically as a "black box" in FIG. 3, are well known in the art. As such, two approximately equal volumes are afforded. In the preferred embodiment, the respective volumes are 1.6 and 3 gallons.

Finally, a pair of flushing mechanisms 22 each include a handle 24 pivotally coupled to an exterior surface of the front face of the toilet water basin. Ideally, the handles remain adjacent to opposite ends of the water basin. A lever 26 is pivotally coupled to an interior surface of the front face of the toilet water basin. The levers of the pair of flushing mechanisms preferably extend toward each other each with an outboard end situated directly above the corresponding upper vertical extent of the dual flush tube. Further, the levers are adapted to rotate coincident with an associated one of the handles by way of a direct coupling. A string 28 is coupled between an outboard end of each lever and an associated one of the lids for selectively opening the same.

During use, a standard water input unit fills the water basin with water to a point above the first upper vertical extent of the dual flush tube, as defined by the water supply cut off mechanism. As such, a user may selectively depress one of the handles so as to effect the dispensing of either a large or small amount of water to the toilet bowl.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A double flush toilet assembly comprising, in combination:

a toilet water basin having a rectangular configuration with a rectangular bottom face and a periphery integrally coupled thereto and extending upwardly therefrom for defining an interior space and an open top, the bottom face having a exit tube with a threaded interior centrally formed therein and extending downwardly therefrom for coupling with a toilet bowl;

a dual flush tube having a lower horizontal extent with a downwardly extending threaded adapter integrally coupled thereto at a central extent thereof and in communication therewith for coupling with the exit tube of the toilet water basin and a pair of upper vertical extents integrally coupled to opposite ends of the lower horizontal extent and extending upwardly therefrom and each terminating in an open end, each open end having a circular lid hingably coupled thereto for pivoting between an open and a closed orientation, wherein a pair of arcuate arms extend from each upper extent to define a pair of forks which are coupleable to a pair of tabs extending from the lid, the upper vertical extents including a first upper vertical extent with a first height and a second upper vertical extent with a second height less than the first height, wherein the first height is at least twice the second height;

a water supply cut off mechanism situated above the upper extent of the first height a distance about equal to a difference between the first height and the second height; and a pair of flushing mechanisms each including a handle pivotally coupled to an exterior surface of the front face of the toilet water basin adjacent to opposite ends thereof, a lever pivotally coupled to an interior surface of the front face of the toilet water basin and located directly above the corresponding upper extent of the flush tube and adapted to rotate coincident with an associated one of the handles, and a string coupled between an outboard end of the lever and an associated one of the lids for selectively opening the same.

* * * * *